United States Patent [19]

Raia

[11] 3,998,293

[45] Dec. 21, 1976

[54] LADDER EXTENSION AND LEVELER

[75] Inventor: Alfred Raia, Kinnelon, N.J.

[73] Assignee: Lawrence Peska Associates, Inc., New York, N.Y. ; a part interest

[22] Filed: Aug. 14, 1975

[21] Appl. No.: 604,710

[52] U.S. Cl. ..... 182/204

[51] Int. Cl.[2] ..... E06C 7/44

[58] Field of Search ..... 182/204, 205, 201, 214

[56] References Cited

UNITED STATES PATENTS

| | | | |
|---|---|---|---|
| 1,246,709 | 11/1917 | Brown | 182/204 |
| 2,146,759 | 2/1939 | Panowitz | 182/204 |
| 2,723,071 | 11/1955 | Merryweather | 182/203 |
| 2,903,086 | 9/1959 | Chubbs | 182/214 |
| 2,936,849 | 5/1960 | Larson | 182/204 |
| 3,032,140 | 5/1962 | Hunt | 182/201 |
| 3,059,723 | 10/1962 | Shore | 182/107 |
| 3,266,593 | 8/1966 | Okie | 182/214 |
| 3,554,321 | 1/1971 | Stedman | 182/201 |

FOREIGN PATENTS OR APPLICATIONS

| | | | |
|---|---|---|---|
| 558,116 | 2/1957 | Italy | 182/204 |

*Primary Examiner*—Reinaldo P. Machado

[57] ABSTRACT

A ladder extension and level that is adapted to be used in conjunction with ladders having hollow rungs and a further embodiment for solid rung ladders.

3 Claims, 7 Drawing Figures

LADDER EXTENSION AND LEVELER

BACKGROUND OF THE INVENTION

This invention relates to a device that is adapted to level a ladder when the same is in the vertically inclined position. More particularly, the invention relates to a device commonly known as a stile extension that is used where the lower end portion of at least one stile or side rail needs a leveling, surface engaging and compensating attachment which is an extensible and compensating attachment therefor.

The invention is adapted for use with aluminum or magnesium hollow rung ladders as well as wooden or iron ladders.

The prior art teaches a variety of ladder devices; for example; U.S. Pat. Nos.: 970,425; 1,609,247; 1,611,057; 1,751,173; 1,862,171; 2,147,052; 3,083,788; 3,447,631; and others. These prior art devices are, however, deficient in that they fail to effectively engage a rung of the ladder; they are more or less permanent parts of the ladder even when not needed; and are employed in tandem.

SUMMARY OF THE INVENTION

It is accordingly an object of the instant invention to avoid one or more drawbacks of the prior art.

It is another object of the invention to provide for a simple yet efficient ladder extension and leveling device.

These and other objects of the invention will become more apparent from the following detailed disclosure and claims and by reference to the accompanying drawings, in which:

Figure 1:
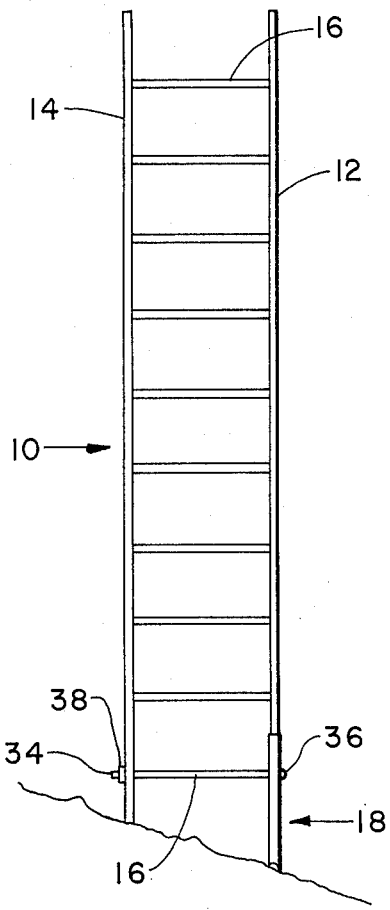
FIG. 1 is a front elevational view of a ladder with the device attached thereto.

Broadly speaking, the instant invention includes the provision of a ladder leveling an extension device for use in connection with ladder side rails and ladder rungs comprising a vertically slidable stile length adjusting unit including an elongated U-shaped channel member having channel walls, the channel defining at least one row of a plurality of vertically disposed apertures spaced at a predetermined distance, the distance corresponding to the distance between successive ladder rungs, the channel walls adapted to embrace and frictionally engage the ladder side surface, connecting means cooperating with the channel member and comprising a threaded member, the means adapted to engage a rung of the ladder thereby resticting the vertical movement of the channel member.

DETAILED DESCRIPTION

Referring more particularly to the drawings in which like elements are designated by like numerals there is a ladder 10 having vertically extending side rails 12, 14 laterally spaced and interconnected by horizontal rungs

16. A ladder leveling and extension apparatus 18 is secured to the lower portion of at least one side rail 12 and rung 16. A ladder 10 supporting skid shoe 20 may be pivotally disposed by suitable pivot means 22 on the lower end of the apparatus 18 that is in contact with the ground.

In the embodiment of the invention directed to hollow rung ladders such as aluminum, magnesium or the like, the apparatus 18 comprises a U-shaped channel member 24 that includes a flat, elongated portion having flanges or channel walls 26 thereon. The channel 24 including the flanges 26 operates to cap or saddle, thereby enbracing the vertical side rail 12. The channel 24 is frictionally engaged to the side rail 12. In order to secure the channel 24 to the side rail 12 and to provide stability, the channel 24 will define a plurality of apertures 28, the distance therebetween corresponding to the distance between the rungs 16. In the hollow rung ladder embodiment (FIG. 2) the apertures 28 are vertically disposed, in a single column. In the solid rung ladder embodiment (FIG. 5), there is present a double column of apertures 28, 30, thereby forming two side by side single rows of vertically disposed apertures 28, 30. The distances between the vertically disposed apertures 28 being as in the hollow rung ladder embodiment (FIG. 2); the horizontal distances therebetween being somewhat greater than the diameter of a rung on the solid rung ladder.

Figure 2:
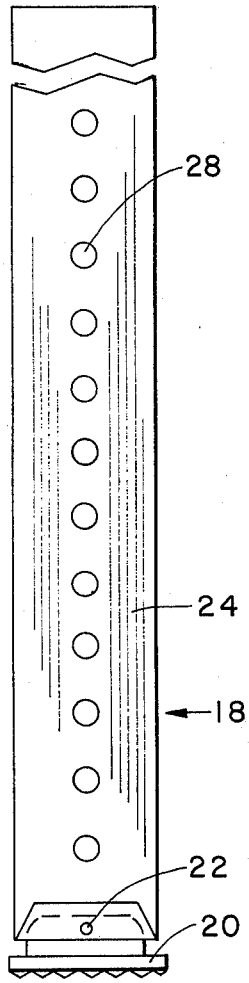
FIG. 2 is a front elevational of the device.
Figure 3:
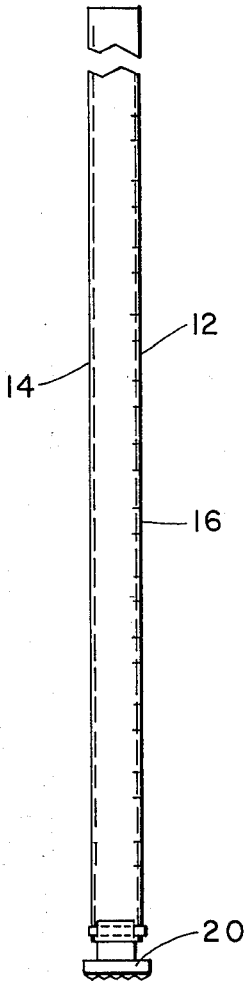
FIG. 3 is a side elevational view of the ladder with the device of FIG. 2 attached thereto.
Figure 4:
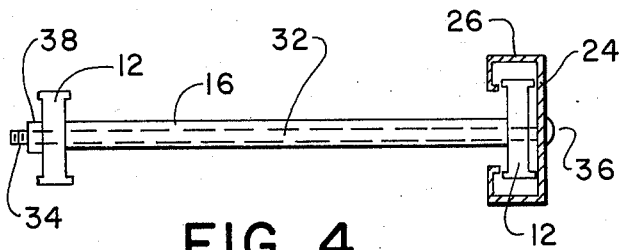
FIG. 4 is a side elevational view of the attachment means for the device of FIG. 2.
Figure 7:
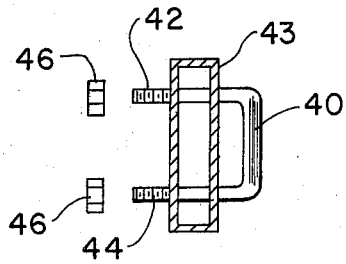
FIG. 7 is similar to FIG. 4 but with the means for the device of FIG. 5.

In practice, the embodiment shown in FIG. 2 is placed such that the aperture 28 corresponds with and overlays the aperture formed in the hollow rung, the desired leveling and extension having been determined. Suitable connecting and securing means, such as an elongated preferably solid shaft 32 having a threaded end portion 34 and enlarged head portion 36 is inserted in mating arrangement, through the hollow of the rung 16. The diameter of shaft 32 being slightly less than that of hollow of the rung such that there is frictional engagement therein. The length of shaft 32 being slightly in excess of the width of the ladder 10 from side rail 12 to side rail 14.

The shaft 32 can define an elongated threaded rod or screw. The head 36 being of a greater diameter than that of the hollow such that it does not slide thereinto. If desired, a slotted head can be provided, or a winged head, etc. Once the shaft 32 has exited from the opposite end of the rung 16 and rail 12 a nut 38 engages the threaded end 34 to secure the same.

Figure 5:
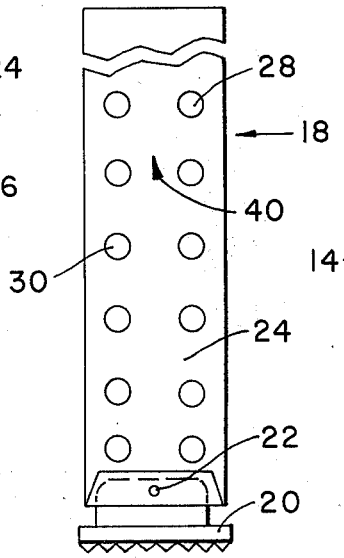
FIG. 5 is similar to FIG. 2 but a different embodiment.
Figure 6:
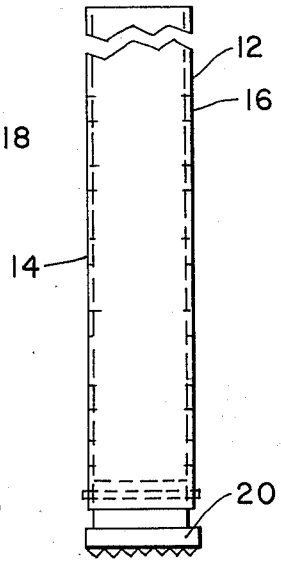
FIG. 6 is similar to FIG. 3 but with the embodiment of FIG. 5.

In the solid rung ladder embodiment, the apparatus of FIG. 5 is saddled or caps the side rail 12 in a position such that the rung 16 is disposed in the area 40 between the parallel rows of vertically disposed apertures 28, 30. Suitable converting and engaging means such as a U-shaped clamp 40 having threaded end portions 42, 44 and a movable collar or median connecting portion 43 and nuts 46 therefor engages a pair of horizontally disposed apertures 28, 30. The end portions 42, 44 passing therethrough, whereupon the median connector 43 is engaged thereby and is disposed over the rung 16. Nuts 46 thereupon engage the end portions 42, 44 and prevent slippage of the apparatus, the rung 16 engaging the connector 40 from below so as to prevent movement.

Since it is obvious that numerous changes and modifications can be made in the above-described details without departing from the spirit and nature of the invention, it is to be understood that all such changes and modifications are included within the scope of the invention.

What is claimed is:

1. A ladder leveling and extension device for use in connection with one distal end of a ladder side rail and hollow ladder rungs, comprising a vertically slideable, elongated U-shaped channel member adapted to embrace and frictionally engage said side rail, a plurality of apertures spaced a predetermined distance apart and centrally disposed in a single vertical row along the longitudinal axis of said channel member, said predetermined distance corresponding to the distance between successive ladder rungs, removable connecting means for maintaining said channel member in a fixed vertical position relative to said side rail, said connecting means including an elongated shaft member, said shaft member having an enlarged head portion at one end, a length greater than the width of said ladder, a diameter less than the inside diameter of said rungs and removable securing means at the opposite end from said one end for enlarging said opposite end to a dimension greater than said inside diameter, said apertures having a greater diameter than said shaft member, said shaft member being adapted to pass through one of said apertures and one of said rungs and to protrude a sufficient distance from said rung to permit attachment of said removable securing means.

2. The device as defined in claim 1 in combination with a ladder having vertically extending side rails and laterally spaced and interconnected by hollow horizontal rungs.

3. The device as defined in claim 1 further including skid means disposed on a lower end portion of said channel member and adapted to communicate with the ground.

* * * * *